United States Patent [19]

Pohl

[11] 4,448,011

[45] May 15, 1984

[54] INERT GAS WHEEL ASSEMBLY

[75] Inventor: Peter H. Pohl, Worthington, Ohio

[73] Assignee: Abbott Laboratories, North Chicago, Ill.

[21] Appl. No.: 307,475

[22] Filed: Oct. 1, 1981

[51] Int. Cl.[3] ..... B65B 31/04; B65B 55/24

[52] U.S. Cl. ..... 53/512; 53/167; 134/179; 141/91; 156/535

[58] Field of Search ..... 53/434, 512, 167; 15/316 R; 134/176, 179; 156/535; 239/13, 251; 141/91

[56] References Cited

U.S. PATENT DOCUMENTS

| | | | |
|---|---|---|---|
| 2,880,938 | 4/1959 | Stewart | 134/179 X |
| 3,125,297 | 3/1964 | Copeland | 239/251 X |
| 3,140,828 | 7/1964 | Garlanor | 239/251 X |
| 3,150,934 | 9/1964 | Hazard | 239/251 X |
| 3,467,302 | 9/1969 | Wilson | 239/251 X |
| 3,619,975 | 11/1971 | Johnson | 53/512 |
| 3,708,952 | 1/1973 | Schulze et al. | 53/512 |
| 3,871,157 | 3/1975 | Domke | 53/512 |
| 3,910,009 | 10/1975 | Canfield | 53/512 |
| 3,942,301 | 3/1976 | Domke | 53/512 |
| 4,017,450 | 6/1977 | Chiu et al. | 53/512 |
| 4,030,513 | 6/1977 | McKenzie | 239/251 |
| 4,140,159 | 2/1979 | Domke | 141/129 |
| 4,262,708 | 4/1981 | de Echeandia | 53/434 X |

*Primary Examiner*—John Sipos

*Attorney, Agent, or Firm*—Neil E. Hamilton

[57] ABSTRACT

An apparatus which can clean powdered material from a filled pouch during a filling operation and at the same time introduce an inert atmosphere into the pouch prior to sealing. The apparatus includes a pair of wheel members mounted on a shaft for opposite rotation, the wheels having apertures which will eject inert gas in an opposing direction. The wheel members serve the dual function of blowing powdered material from the top of the filled pouch while at the same time introducing an inert atmosphere therein. The wheel assembly is especially suited for a high speed filling operation such as that commonly found in conjunction with a multiple stationed and rotatable filling apparatus.

9 Claims, 7 Drawing Figures

INERT GAS WHEEL ASSEMBLY

BACKGROUND OF THE INVENTION

This invention relates to an apparatus for cleaning the tops of containers prior to sealing as well as introducing an inert atmosphere into the container. More particularly, it relates to wheel members which are mounted on a shaft and have channels and apertures therein so that when gas under pressure is introduced therethrough the wheels will rotate in an opposing direction to thereby effect the indicated cleaning and introduction of the desired inert atmosphere. The maintaining of an inert atmosphere during the filling operation of a container is the subject of the following U.S. Pat. Nos.: 3,619,975; 3,871,157; 3,708,952; 3,910,009; 3,942,310; 4,027,450; and 4,140,159.

In the forementioned patents, the inert atmosphere is created or maintained in a container either by means of a manfold system or through the introduction of a tubular member such as a nozzle.

The prior art does not provide a fast and efficient mechanism which is simple in its construction yet can operate at fast filling rates which are required in a high speed packaging operation. Neither does the prior art afford a unit which can both clean the top of a container as well as introduce the inert atmosphere therein and which is specifically constructed for use with a pouch made of flexible plastic material to be filled with a powdered material.

It is an advantage of the present invention to provide an apparatus which can simultaneously clean filling material from a container yet at the same time provide an inert atmosphere in the container prior to sealing. Other advantages are a combined cleaning and inert gas introduction mechanism which is simple in its construction yet can operate at high production speeds; can be easily integrated into an existing container filling operation without great cost; requires a minimum number of parts and can operate without an additional mechanism to rotate the wheel members and is operable with various types of inert gaseous fluids.

SUMMARY OF THE INVENTION

The foregoing advantages are accomplished and the shortcomings of the prior art are overcome by the present apparatus for cleaning material to be sealed in a container pouch while introducing an inert atmosphere therein, the apparatus including a shaft member with at least two apertured members mounted in proximity to each other and for opposing rotation of the shaft. The shaft member and the apertured members include interconnecting fluid passage means for fluid communication with a pressurized source of inert fluid material. The apertures in the apertured members are in fluid communication with channels constructed and arranged to provide rotation of one of the apertured members in one direction and the other apertured member in an opposite direction when the inert gas is directed under force through the fluid passage means. Suitable means are afforded to place the pouches at a position below the apertured members with the openings of the pouches adjacent to the apertured members. When the inert gas is forced through the apertures the rotatable members will move in opposing directions to remove any of the filling material from outside of and adjacent the opening of the pouch as well as to introduce an inert atmosphere therein. In a preferred manner, the apertured members are defined by wheel members and are spaced apart by a separating member with the channels extending from the central portion of the wheel member to the outer surface thereof. Also preferably, the outer surface of the wheel members is substantially flat and the channels define flow paths having a direction substantially tangential to the outer surface. The apertures are uniformally positioned around the outer surface with the apertures in one wheel member being offset from those in the other wheel member. The rotatable wheel members can be suitably positioned in conjunction with a rotating filling and sealing station and immediately above a placement or holding area for the recently filled pouch. The rotating, filling and sealing station will include means to continuously supply the containers to the holding or placement area as well as suitable filling hoppers to fill the pouches with powdered material. The preferred gas for rotating the wheel members, cleaning the powdered material from the upper regions of the pouch, as well as filling the pouch with an inert atmosphere is nitrogen gas.

BRIEF DESCRIPTION OF THE DRAWINGS

A better understanding of the present apparatus for cleaning container pouches after a filling operation as well as introducing an inert atmosphere therein will be afforded by reference to the drawings wherein.

DESCRIPTION OF THE PREFERRED EMBODIMENT

Figure 1:
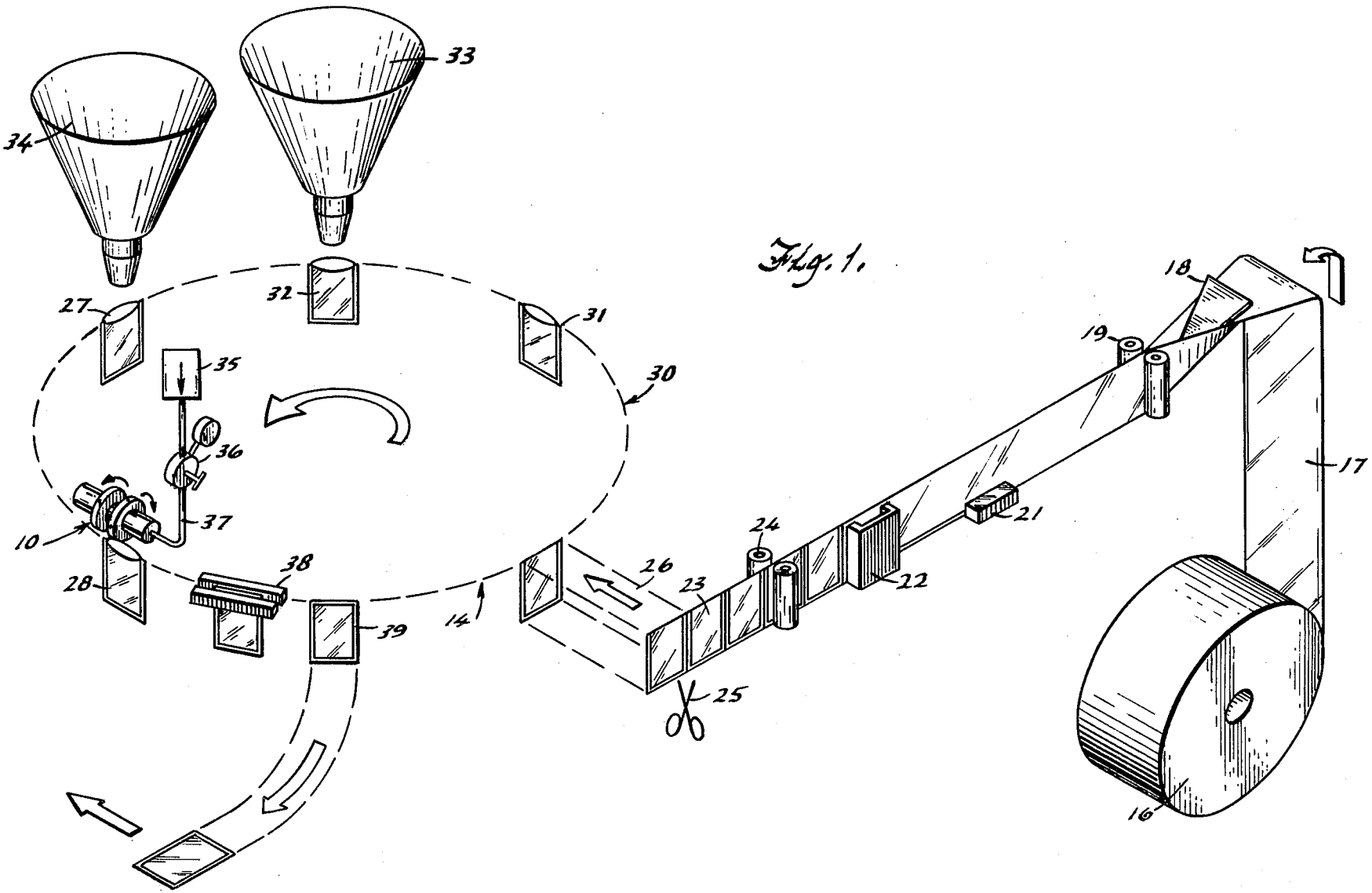
FIG. 1 is a diagramatic view illustrating a pouch forming and filling assembly with the rotatable members operatively positioned between the filling station and the sealing station.

Proceeding to a detailed description of the invention, and referring particularly to FIG. 1, the inert gas wheel assembly 10 is shown in conjunction with a pouch forming and filling assembly generally 14. The pouch forming and filling assembly includes the usual feed roll 16 containing plastic film sheet material with the sheet material being fed by the usual means past a folding member 18 and roller pairs 19 whereby the sheet material is folded into two equal lengths with an open top. The sheet material will move past a bottom sealer 21 and subsequently a side sealer 22 as well as between two additional guide rollers 24. At this stage, pouches 23 will be sealed at the bottoms and along their sides. At station 25 they will be cut along their side seams to result in individual pouches which are moved by a transfer station 26 to a rotating filling and sealing mechanism 30, having suitable means for holding the containers and moving them through a circular path. At station 31, they will be opened to result in an open pouch 32 which will be placed beneath filling hoppers 33 and 34 containing the usual material to be filled in the plastic pouches which in this instance will be a powdered and flowable material such as a hydrolyzable, low-residue food sold under the trademark, VITAL. After being filled, the pouches will move to a placement or holding station as indicated by the position of container 28 below the wheel assembly 10. At station 38, the top of the container will be sealed, and at 39 the filled and sealed container will be unloaded from the rotatable filling and sealing mechanism 30. Inert pressurized gas such as nitrogen will be available from source 35 with the pressure regulated by regulator 36. It will be supplied to the wheel assembly by means of gas line 37.

Figure 3:
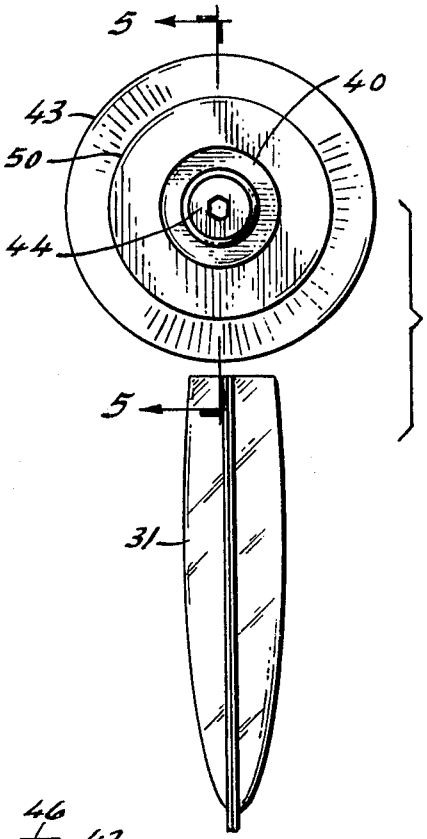
FIG. 3 is an end view of the filled pouch and the rotatable members as seen in FIG. 2.
Figure 4:
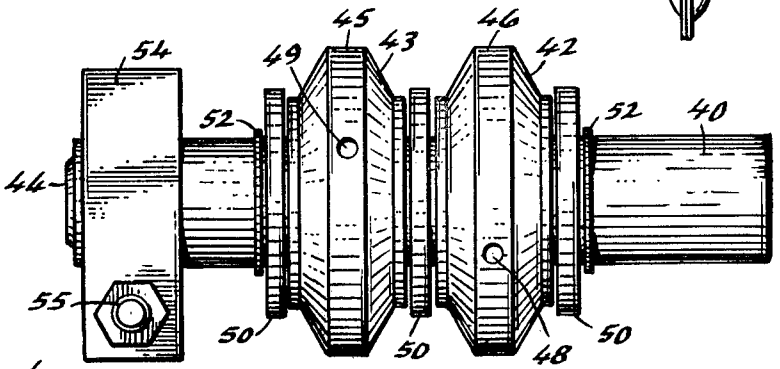
FIG. 4 is a view in side elevation illustrating the two rotatable members as they are spaced from each other and supported for rotation on a shaft member.
Figure 2:
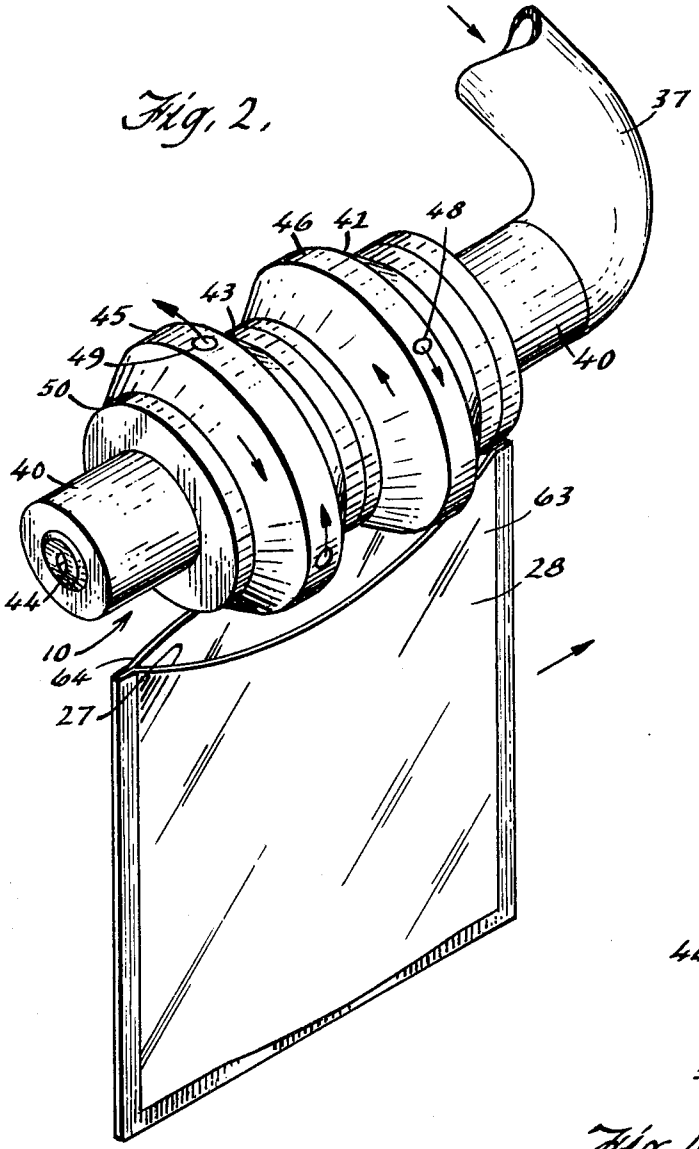
FIG. 2 is an enlarged perspective view illustrating the rotatable members during the removal of powdered material from the upper regions to the pouch as well as the introduction of an inert gas therein.

As best seen in FIGS. 2, 3 and 4, the inert gas wheel assembly 10 includes a shaft 40 interconnected to gas line 37, shaft 40 being closed by plug 44. Two apertured wheels 42 and 43 are rotatably mounted on shaft 40 by means of spacing washers 50 and retaining rings 52. Wheels 42 and 43 have flat surfaces 46 and 45 respectively as well as apertures 48 and 49 extending therefrom. The washers 50 separate the two wheels 42 and 43 from each other as well as from retaining rings 52, the latter providing suitable retention on shaft 40. The usual mounting block 54 engages shaft 40 through mounting nut and bolt for purposes of positioning the wheel assembly in a suitable manner in conjunction with a recently filled container.

Figure 7:
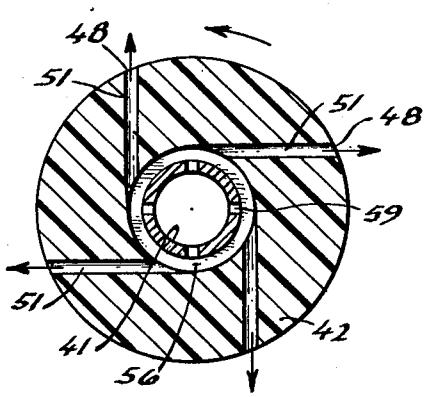
FIG. 7 is a view in vertical section taken along line 7—7 of FIG. 5.
Figure 5:
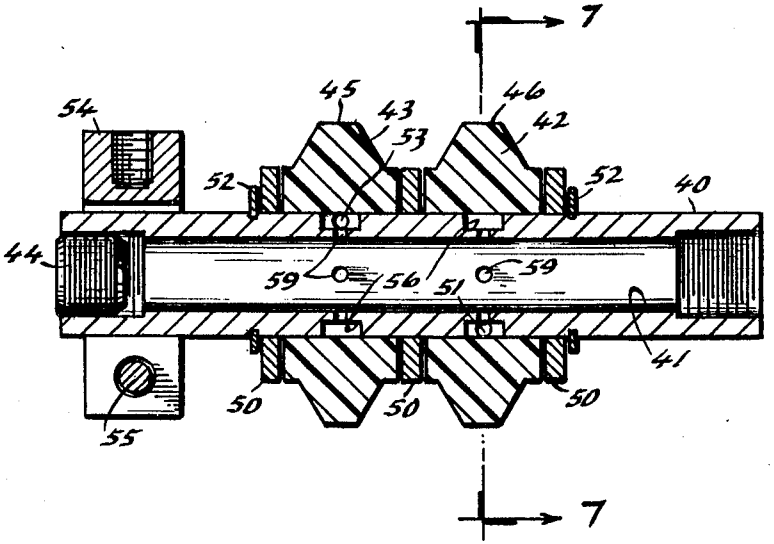
FIG. 5 is a view in vertical section of the rotatable members supported for rotation on a shaft member as shown in FIG. 4 and illustrating a hollow shaft and channels in the rotatable members in communication therewith.
Figure 6:
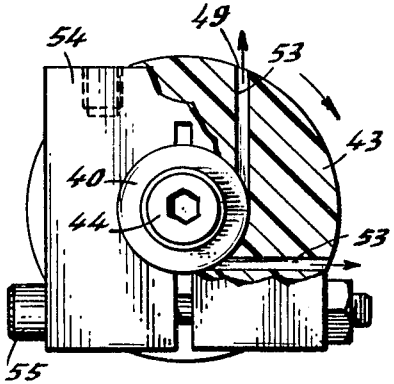
FIG. 6 is a partial view in vertical section showing the channels in one of the rotatable members for purpose of effecting rotation.

FIGS. 5, 6 and 7 illustrate the flow of pressurized gas through the wheel assembly 10. It will be seen that hollow shaft 40 presents a central passageway 41 with four passages 59 spaced 90° from each other and extending between central passageway 41 and annular passage 56. Four channels 51 and 53 are disposed in each wheel extending tangentially from annular passage 56 to the surface of the wheel to result in apertures 48 and 49.

OPERATION

A better understanding of the advantages of the inert gas wheel assembly 10 will be had by a description of its operation. The pouch forming and filling assembly was previously described and accordingly it is not deemed to be necessary to repeat it. Suffice it to say that after the flexible pouches leave the filling stations as represented by the hoppers 33 and 34, in the rotatable filling and sealing mechanism 30, some of the powdered material will have been left in contact with the area outside and inside the pouches adjacent the opening as represented by the numeral 27. As the filled pouches are moved from the filling station to the placement station 28 beneath the wheel assembly 10, nitrogen gas under pressure will be fed to pipe 37 and into hollow shaft 40. As the pressurized gas flows into pipe 40 the gas will pass through manifold passages 59 and into manifold passages 56. This flow of gas and the tangential positioning of channels 51 and 53 as well as the apertures 48 and 49 will effect a rotation of the wheels. Channels 53 in wheel 43 will be positioned 90° out of phase with respect to channels 51 in wheel 42 to effect a rotation in opposing directions as indicated by the directional arrows in FIG. 2. As a filled container 28 passes in a continual manner below the wheels 42 and 43, the nitrogen gas exiting from the apertures 48 and 49 will effect a blowing away of any powdered material near the top of the container. As viewed in FIG. 2, it will be seen that the gas exiting from the apertures 48 on wheel 42 will blow over and against the front panel 63 whereas the gas exiting from apertures 49 on wheel 43 will effect a removal of powdered material from the upper regions of back panel 64. It will be noted that as the gas exits from the apertures it will also be directed into the filled container 28 as the apertures move between opening 27 and particularly when the apertures are directed substantially downwardly and in a transverse direction with respect to shaft 40. By having the wheels 42 and 43 move in opposing directions, they can clean both panels of a container in a thorough manner, yet both wheels will introduce inert nitrogen into the container.

The nitrogen wheel assembly 10 of this invention has been utilized in conjunction with a pouch filling operation wherein pouches have been filled with a powdered food product at the rate of 60–100 pouches per MIN. These pouches were subsequently sealed in the usual manner with a reject rate of less than 1%. While nitrogen gas is the preferred inert gaseous media for blowing the powdered material away from the upper regions of the pouch and introducing an inert atmosphere therein, other inert gasses such as carbon dioxide could be substituted. While the wheel assembly of this invention is utilized in conjunction with plastic pouches, it will be appreciated that they could be advantageously employed to clean any foldable material from the top of a container which has a substantially longitudinal profile at the top. Two rotatable wheels have been illustrated for rotation in opposite directions. It will be appreciated any number of such wheels could be assembled on suitable shafts and rotated in any feasible opposing patterns.

In a preferred manner the four apertures 48 on wheel 42 are uniformly spaced from and offset from the four apertures 49 on wheel 43. Any number of such apertures could be utilized and arranged in various positions with the apertures on the other wheel and still accomplish the desired advantages of this invention.

The preferred material for fabricating the wheels 42 and 43 is nylon. However, other rigid plastic materials such as polyvinyl chloride could be substituted as well as metal.

It will thus be seen that through the present invention there is now provided unique device for cleaning filled containers which will simultaneously introduce an inert atmosphere therein. An inert gas serves the function of not only rotating the wheel members but also acting as a force to remove powdered material from a container and provide the inert atmosphere by displacing oxygen therefrom. The inert gas wheel assemblies are simple in their construction, yet can be readily fabricated without expensive tooling. Further, due to the simplicity of their construction, they can be readily adapted and mounted in conjunction with any existing pouch-type filling operating.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

What is claimed is:

1. An apparatus for cleaning filling material from filled pouches to be sealed and for injecting inert gas into said pouches, said container pouches having opposing flexible walls with an opening at the top:

a shaft member;

at least two apertured members mounted in proximity to each other and for opposing rotation on said shaft member;

said shaft member and said apertured members including interconnecting fluid passage means;

means to supply a pressurized inert gas to said fluid passage means in said shaft member;

said apertured members including channels constructed and arranged to provide rotation of one of the apertured members in one direction and the other apertured member in an opposing direction in reaction to the force of the inert gas directed through said fluid passage means; and means to place said pouches at a position below said apertured members with the opening and said flexible opposing walls adjacent thereto;

whereby when said inert gas is forced through said apertures, said rotatable members will move in opposing directions to remove said material from the outside of and adjacent the opening of said pouch as well as to introduce an inert atmosphere therein.

2. The apparatus for cleaning container pouches as defined in claim 1 wherein said apertured members are defined by wheel members.

3. The apparatus as defined in claim 1 wherein said means to supply a pressurized inert gas is a source of nitrogen gas.

4. The apparatus as defined in claim 3 further including means to continuously supply said container to said placement means.

5. The apparatus as defined in claim 4 wherein said means to continuously supply said containers to said placement means also includes means to supply powdered material into said pouches when they are opened.

6. The apparatus as defined in claim 2 wherein said wheel members are represented by two wheel members spaced apart by a separating member with said channels extending from the central portion of said wheel member to the outer surface thereof.

7. The apparatus as defined in claim 6 wherein said outer surface of said wheel members is substantially flat.

8. The apparatus as defined in claim 7 wherein said channels define flow paths having a direction substantially tangential to said outer surface.

9. The apparatus as defined in claim 8 wherein said apertures are uniformly positioned around said outer surface and said apertures in one wheel member are offset from those in the other wheel member.

* * * * *